US007003855B2

(12) United States Patent
Lew

(10) Patent No.: US 7,003,855 B2
(45) Date of Patent: Feb. 28, 2006

(54) COLLAPSIBLE CARDBOARD CREMATION CASKET

(76) Inventor: Chen Lew, 505 W. Olive Ave., Suite 330, Sunnyvale, CA (US) 94086

( * ) Notice: Subject to any disclaimer, the term of this patent is extended or adjusted under 35 U.S.C. 154(b) by 0 days.

(21) Appl. No.: 09/855,814

(22) Filed: May 14, 2001

(65) Prior Publication Data

US 2002/0166217 A1 Nov. 14, 2002

(51) Int. Cl.
*A61G 17/00* (2006.01)

(52) U.S. Cl. ..... 27/4; 27/14; 27/17

(58) Field of Classification Search ..... 27/2, 27/4, 35, 14, 19, 17; 229/125.01, 125.19, 229/125.29, 125.36; 220/6
See application file for complete search history.

(56) References Cited

U.S. PATENT DOCUMENTS 4,063,337 A 12/1977 Havey, III
4,146,167 A * 3/1979 Pascus ..... 229/125.29
4,156,956 A 6/1979 Partridge et al.
4,170,054 A 10/1979 Ruffner et al.
4,773,134 A 9/1988 Kay
4,944,076 A 7/1990 Kay
5,307,545 A * 5/1994 Stoltz ..... 27/4
5,353,484 A 10/1994 Woedl et al.
5,425,163 A 6/1995 Von Braun et al.
5,454,141 A 10/1995 Ozbun et al.
5,485,661 A 1/1996 McClure
5,586,679 A * 12/1996 Thomas ..... 27/4
5,661,879 A 9/1997 Kelly
5,685,937 A 11/1997 Tambussi
5,709,016 A 1/1998 Gulick et al.
5,771,549 A 6/1998 Saaf
5,960,978 A 10/1999 Jenkins
5,985,399 A 11/1999 Tambussi
6,105,220 A 8/2000 Belanger

* cited by examiner

*Primary Examiner*—William L. Miller

(57) ABSTRACT

A collapsible cremation casket is formed of cardboard and has the appearance of a typical wood or plastic casket. The casket is assembled by folding along pre-scored lines to form a two-piece domed lid having a plurality of slots on the bottom and a set of slots in the back edge. The slots engage a plurality of tabs extending upward from the top of the back wall of the tray. Tabs within the slots on the back wall of the lid and the slope of the back wall of the tray provide support for the lid to stand in an upright position. When the tray is covered with the lid, the tabs engage the slots in the bottom wall of the lid, thereby securely holding the lid in place. During a ceremony, one lid section may be closed position and the second lid section is upright, thereby giving the appearance of a standard two-part casket lid.

20 Claims, 14 Drawing Sheets

COLLAPSIBLE CARDBOARD CREMATION CASKET

FIELD OF INVENTION

The present invention relates generally to caskets. More particularly, it relates to an environmentally-friendly, collapsible cremation casket suitable for viewing during a funeral service.

BACKGROUND OF THE INVENTION

As population increases and land becomes more valuable, cremation has become more popular in the United States and around the world. For environmental reasons, it is preferred to use only materials that are fully combustible and non-toxic when cremating a body. For this purpose, cardboard containers have been created. The current cardboard containers are configured similar to a standard cardboard box. However, if a funeral service is held, the appearance of the container holding the body is important. For most people, the current cardboard container designs are insufficient in appearance for a service. Therefore, the cardboard containers are typically only used when a funeral service will not be held.

Another alternative is to use a rental casket for the funeral service and use a disposable insert that is taken out with the body and cremated. However, rental caskets are still quite expensive and shipping considerations may make it difficult or prohibitively expensive to use.

There are also several versions of caskets that use fiberboard or other materials. However, these versions have one or more of the following problems: non-combustible hinges, inadequate appearance for a funeral service, high shipping costs and/or limited availability areas.

Therefore, there is a clear need in the industry for an environmentally-friendly, entirely combustible, cremation casket that can be shipped economically, while maintaining a suitable appearance for a funeral service.

SUMMARY OF THE INVENTION

In keeping with these objectives, the present invention takes the form of a cremation casket formed entirely of cardboard and useable with a combustible and environmentally friendly fabric liner. The cardboard casket is formed to have the appearance of a typical wood or metal casket, but is collapsible for easy shipping and storage and is formed completely of combustible, non-toxic materials. The casket may be shipped in a flat bundle then folded along pre-scored or pre-folded lines to form a two-piece domed lid having a plurality of slots on the bottom and a set of slots in the back side. The slots engage a plurality of tabs extending upward from the top of the back wall of the tray. Tabs within the slots on the back wall of the lid and the slope of the back wall of the tray provide support for the lid to stand in an upright position. When the tray is covered or closed with the lid, the tabs engage the slots in the bottom wall of the lid, thereby securely holding the lid in place. During a ceremony, one section of the lid may be placed in the closed position and the second section of the lid may be placed in the upright position, thereby giving the appearance of a standard two-part casket lid. The inside of the casket and one or more sections of the lid may be lined with any suitable material such as is typically used in caskets.

Other objects and advantages of the invention will no doubt occur to those skilled in the art upon reading and understanding the following detailed description along with the accompanying drawings.

DETAILED DESCRIPTION OF THE INVENTION

Figure 1:
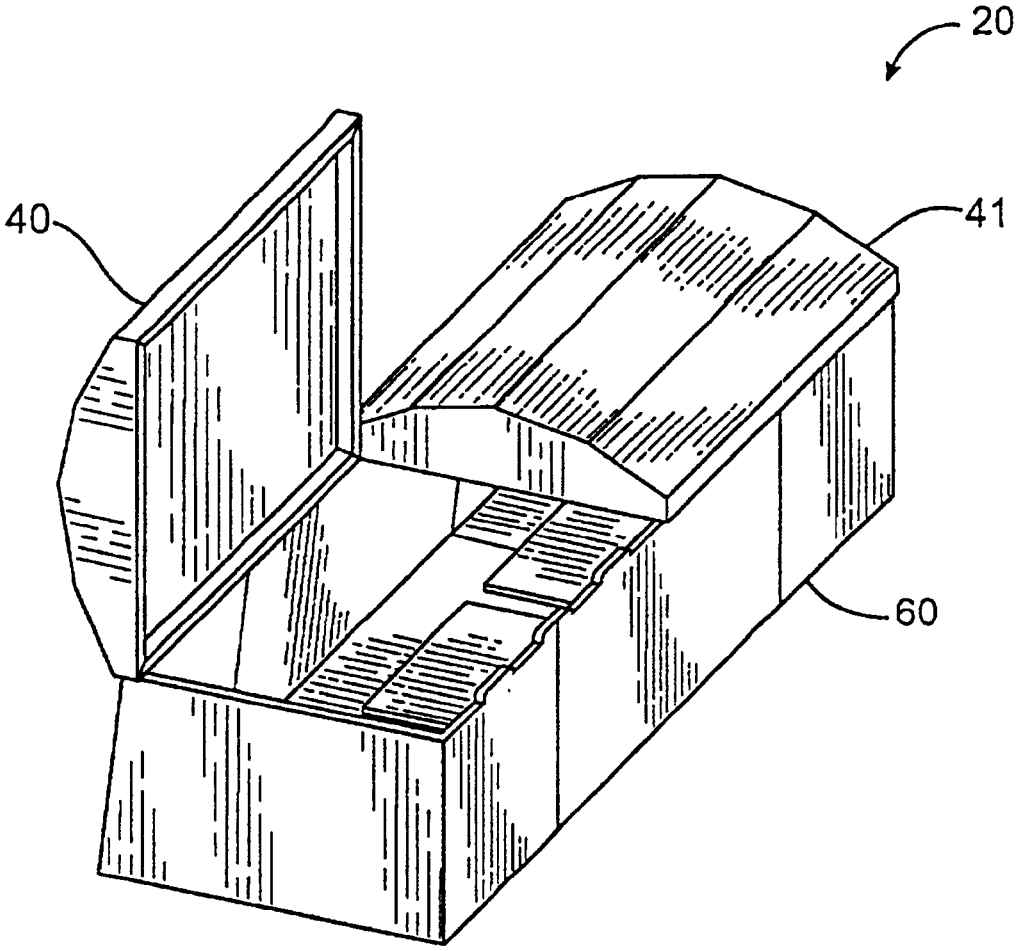
FIG. 1 is an assembled view of the cremation casket with one of the lid sections standing upright.
Figure 2:
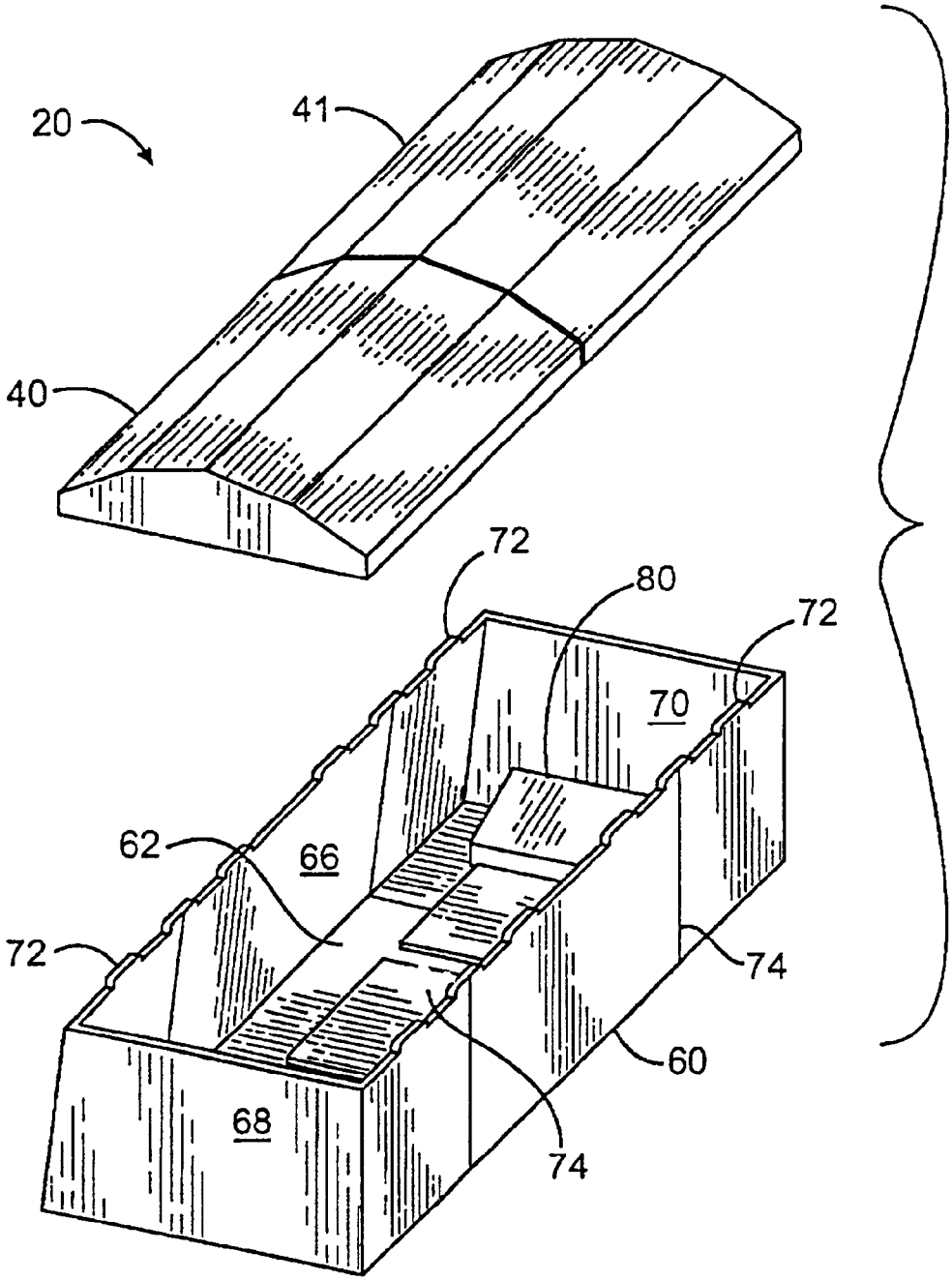
FIG. 2 is an exploded perspective view of the cremation casket.
Figure 3:
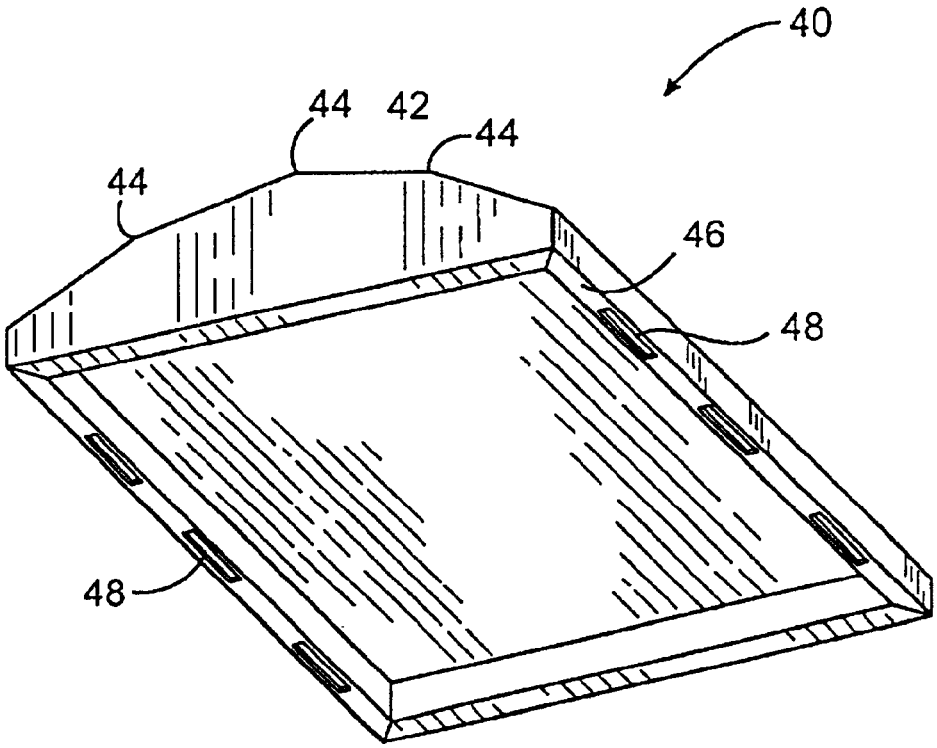
FIG. 3 is a bottom perspective view of one lid section of the cremation casket.
Figure 8:
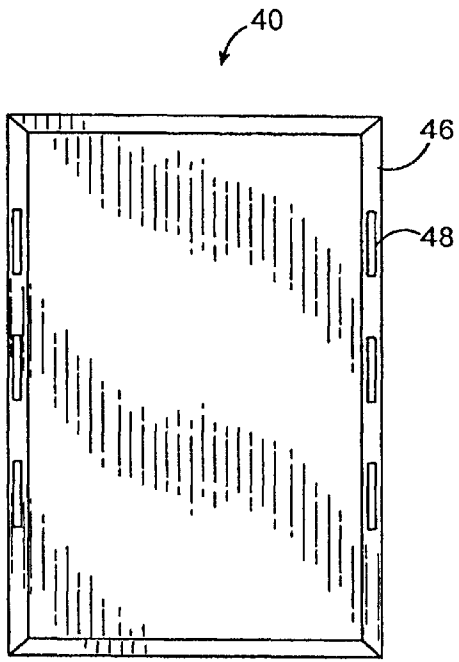
FIG. 8 is a bottom view of a lid section of the cremation casket.
Figure 7:
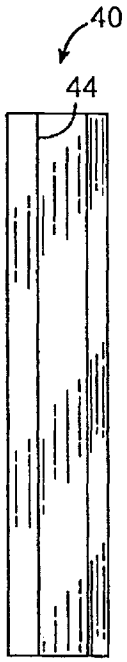
FIG. 7 is a front view of the lid section of the cremation casket.
Figure 6:
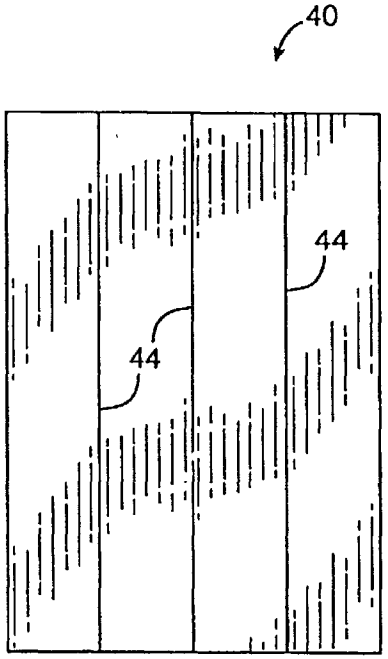
FIG. 6 is a top view of a lid section of the cremation casket.
Figure 5:
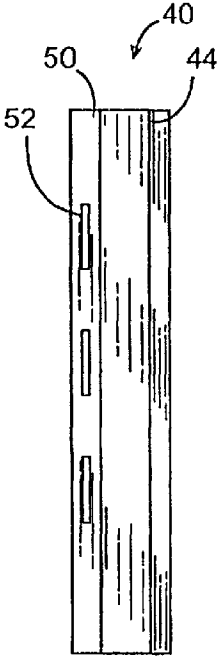
FIG. 5 is a back view of the lid section of the cremation casket.
Figure 9:
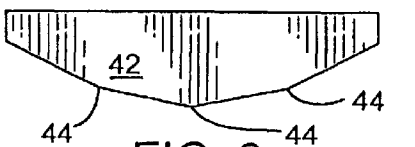
FIG. 9 is a back end view of a lid section of the cremation casket.
Figure 4:
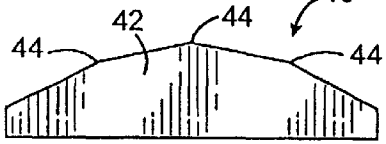
FIG. 4 is a front end view of a lid section of the cremation casket.
Figure 10:
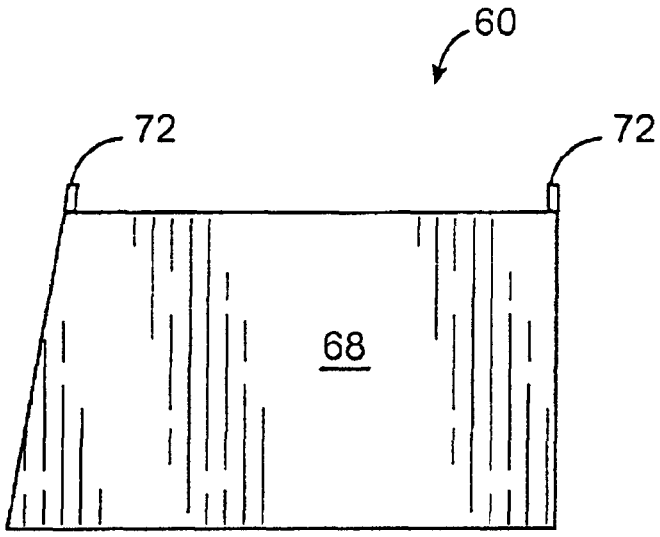
FIG. 10 is a left side view of the tray section of the cremation casket.
Figure 11:
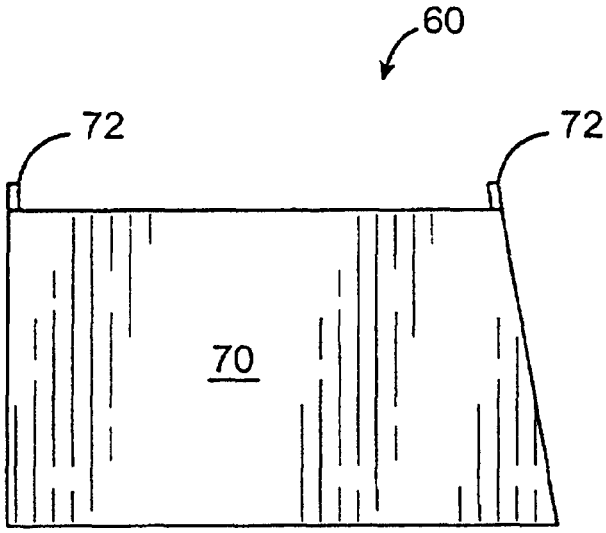
FIG. 11 is a right side view of the tray section of the cremation casket.
Figure 12:
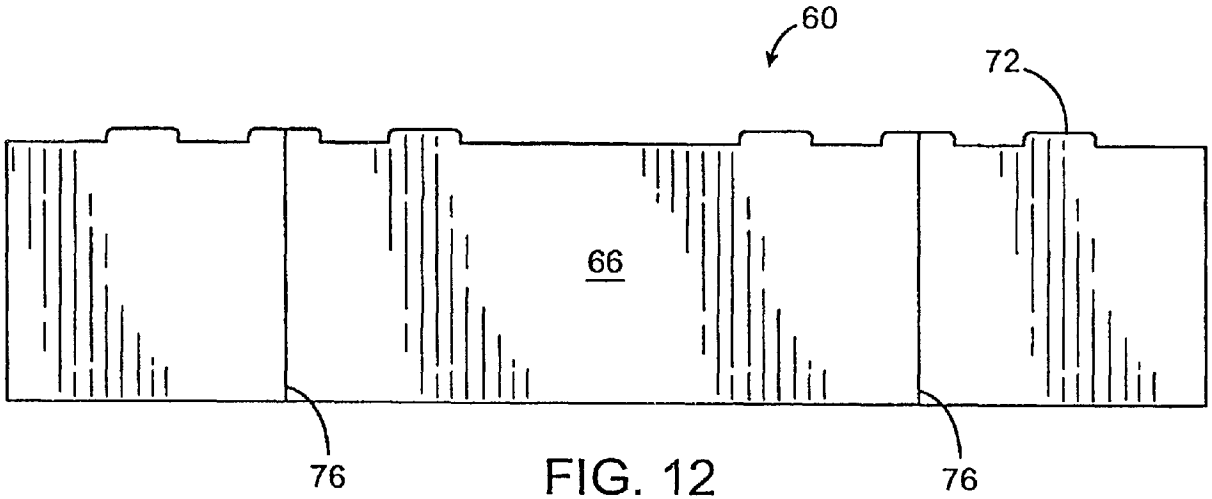
FIG. 12 is a back view of the tray section of the cremation casket.
Figure 13:
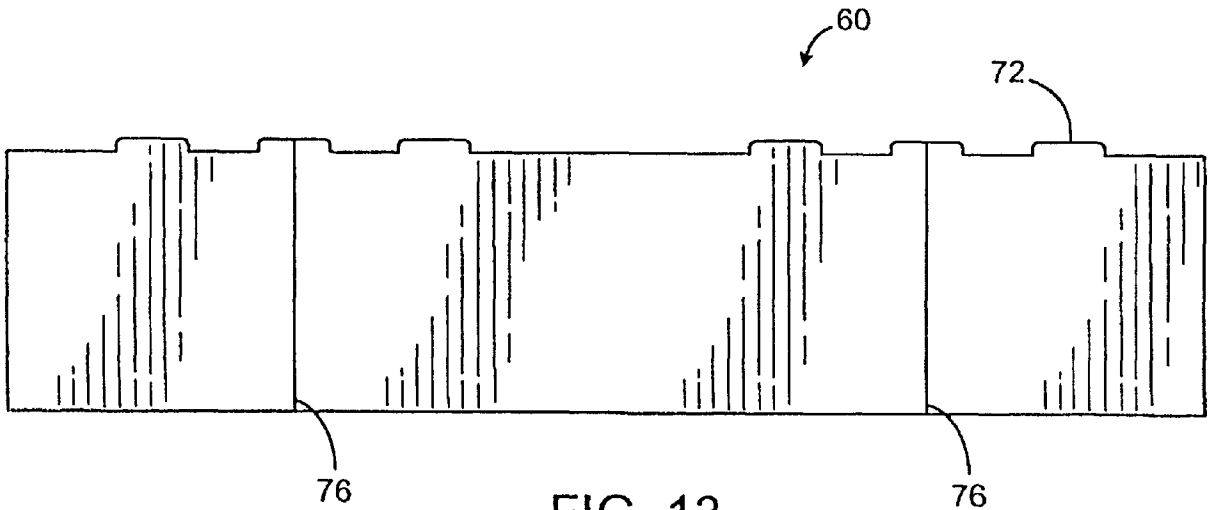
FIG. 13 is a front view of the tray section of the cremation casket.
Figure 14:
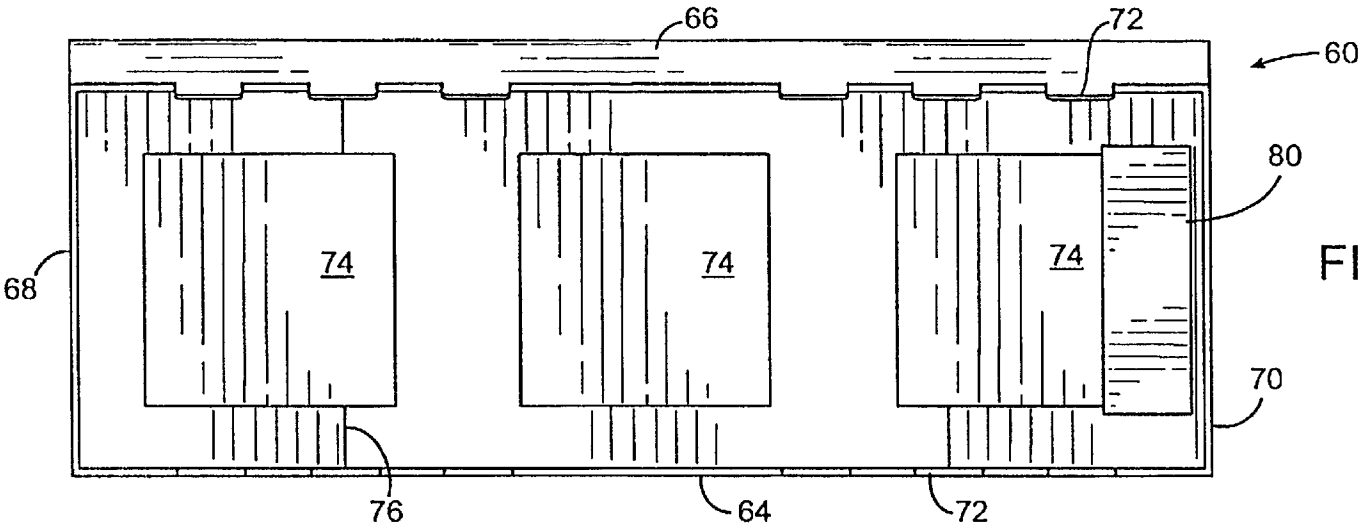
FIG. 14 is top view of the tray section of the cremation casket.
Figure 15:
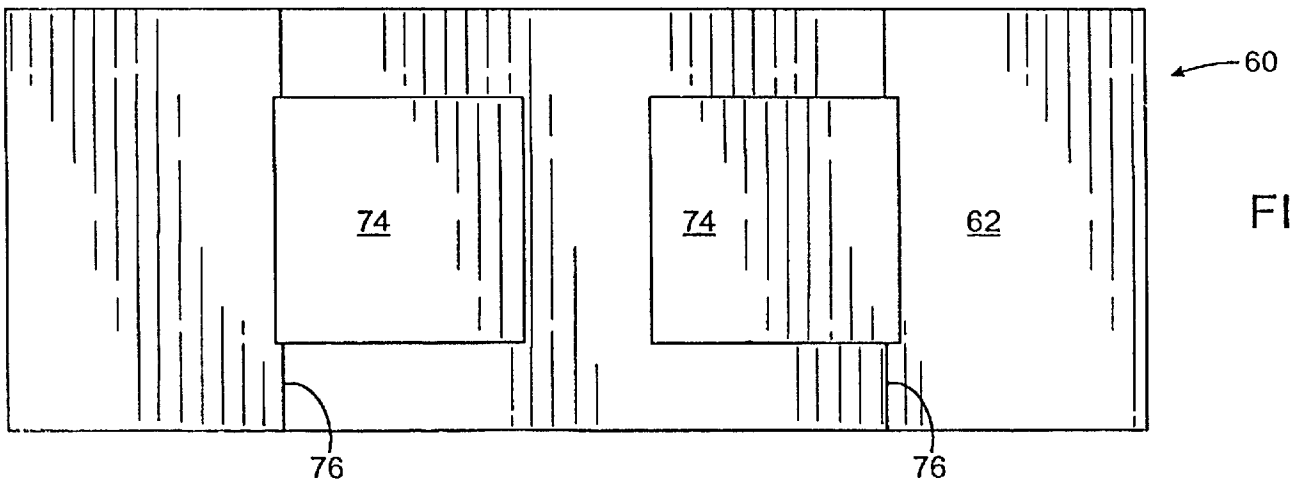
FIG. 15 is a bottom view of the tray section of the cremation casket.

FIG. 1 is an assembled view of the cremation casket 20, and FIG. 2 an exploded perspective view of the cremation casket 20. FIG. 3 is a bottom perspective view of one lid section 40 of the cremation casket 20. FIGS. 4–9 are front end, back, top, front, bottom and back end views of the lid section 40 of the cremation casket 20. FIGS. 10–15 are front end, back end, left, right, top and bottom views of the tray section 60 of the cremation casket 20.

The cremation casket 20 is formed of three main sections: a tray 60 and two lid sections 40. The tray 60 has a solid bottom 62 and four generally upstanding walls 64, 66, 68, 70 extending therefrom. A plurality of tabs 72 extend upward from the top edge of the front wall 64 and the back wall 66 of the tray 60. The back wall 66 of the tray 60 is slanted from vertical. The back wall 66 forms an angle to the bottom panel 62 of the tray 60. The angle may be anywhere from about 60 to 100 degrees making the angle from vertical from 0 to 30 degrees, more preferably from 70 to 85 degrees making the angle from vertical from 5 to 20, most preferably between 75 to 85 degrees making the angle from vertical from 5 to 15. The embodiment show has an angle of approximately 80 degrees making the angle from vertical approximately 10 degrees. For additional support one or more stiffening panels 74 may be added to the inside and outside surfaces of the bottom panel 62. The stiffening panels 74 are preferably also made of cardboard, but having a honeycomb configuration for additional strength. In the embodiment shown, there are a total of five stiffening panels 74: three on the inside and two on the outside surface. An additional benefit of the stiffening panels 74 on the outside surface, is that the panels 74 raise the edges of the tray 60 thereby allowing a person to easily slip their fingers, a strap or bar under the edge of the tray 60 for lifting. The tray section also has one or more fold lines 76 to allow the prefolded cut-out to be folded down to form a smaller dimension bundle for shipping. The embodiment shown has two fold lines 76 allowing the cut-out to be folded into thirds.

The lid 40 is a two-part lid 40, 41. Each lid 40, 41 is dome shaped, similar to a standard casket. The dome portion 42 is formed of cardboard with a plurality of folds 44 forming oblique angles. The dome section 42 may be formed with anywhere between two and an infinite number of folds 44, more preferably between three and eleven folds 44, most preferably between three and seven folds 44. In the embodiment shown, the dome 42 has three folds 44, forming four sections. The bottom edge 46 of the lid 40 has a flat surface with a plurality of slots 48 extending therethrough. The slots 48 are sized and configured to match the tabs 72 extending upward from the front and back walls 64, 66 of the tray 60, thereby locking the lids 40, 41 in position when the lids 40 are placed over the tray 60 to close the casket 20. The flat surface of the bottom edge 46 of the lid 40 also creates the appearance of depth as is seen in standard caskets. On one side of the outer edge 50 of the lid 40 is a plurality of slots 52 extending through the upstanding wall 50. These slots 52 also are sized and configured to match the tabs 72 extending upward from the back wall 66 of the tray 60. In this case, when the tabs 72 are secured within the slots 52, the lid 40 is held in the upright position. The angle of the back wall 66 assists in holding the lid 40 upright. With the configuration shown, an angle of 10 degrees holds the lid 40 approximately vertical. However, depending on the configuration of the lid 40 and the corresponding location of the center of gravity of the lid 40 with relation to the back wall 66 and tabs 72 of the tray 60, the angle may be more or less to hold the lid 40 generally vertical. Alternately, the user may want to hold the lid 40 somewhat off of vertical, in which case, the angle of the back wall 66 would again be adjusted to create the chosen angle. Although slots 52 in the upstanding wall 50 are not necessary for the second lid section 41, for ease of manufacturing, both lid sections 40, 41 may be the same and have both sets of slots 48, 52. In alternate embodiment, the lid 40 may be formed of a single longer section. The single lid 40 version would be applicable for closed casket services.

Figure 16:
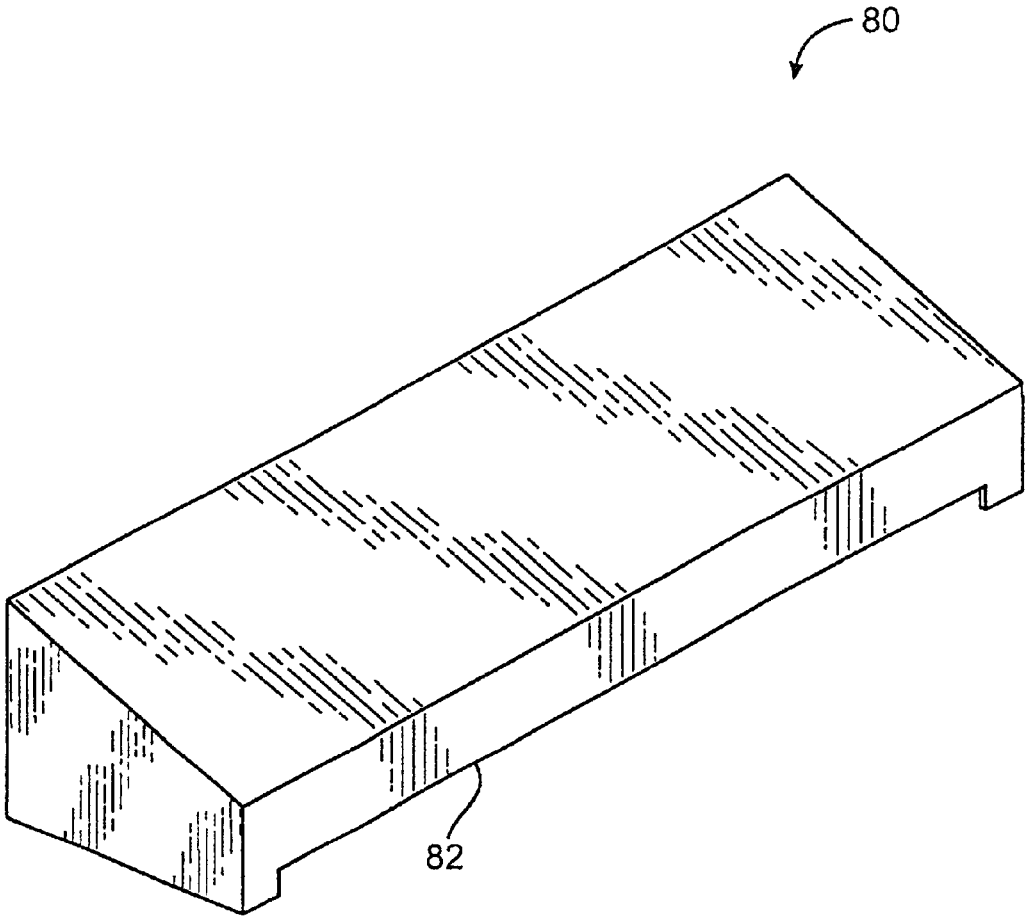
FIG. 16 is a perspective view of a headrest for the cremation casket.
Figure 17:
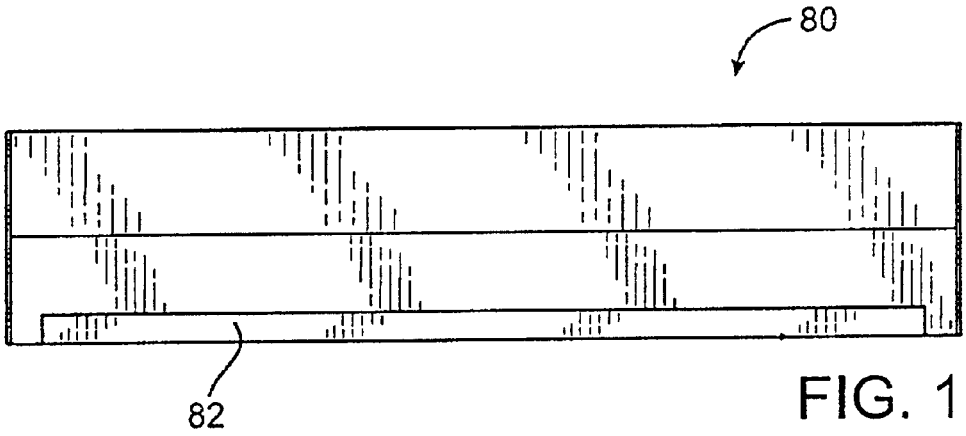
FIG. 17 is a front view of the headrest.
Figure 18:
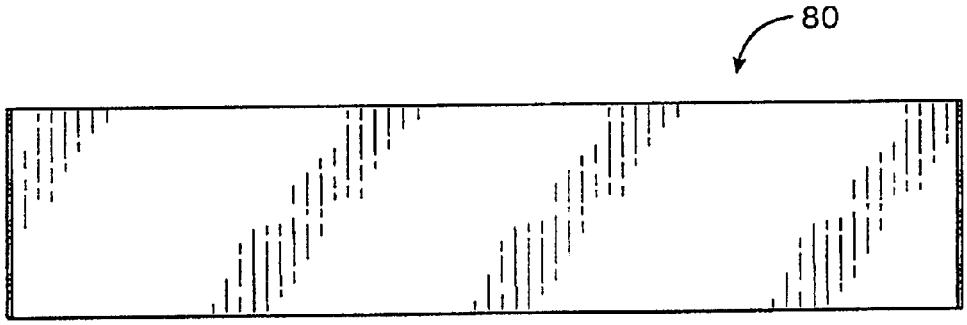
FIG. 18 is a back view of the headrest.
Figure 19:
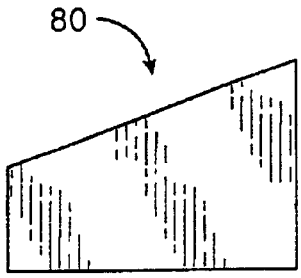
FIG. 19 is a right side view of the headrest.
Figure 20:
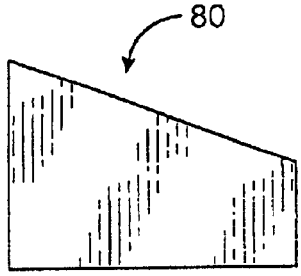
FIG. 20 is a left side view of the headrest.
Figure 21:
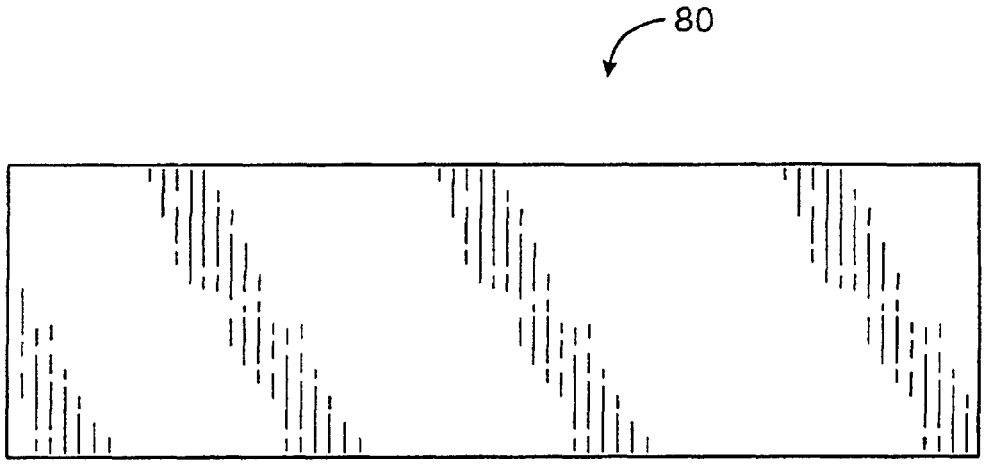
FIG. 21 is a top view of the headrest.
Figure 22:
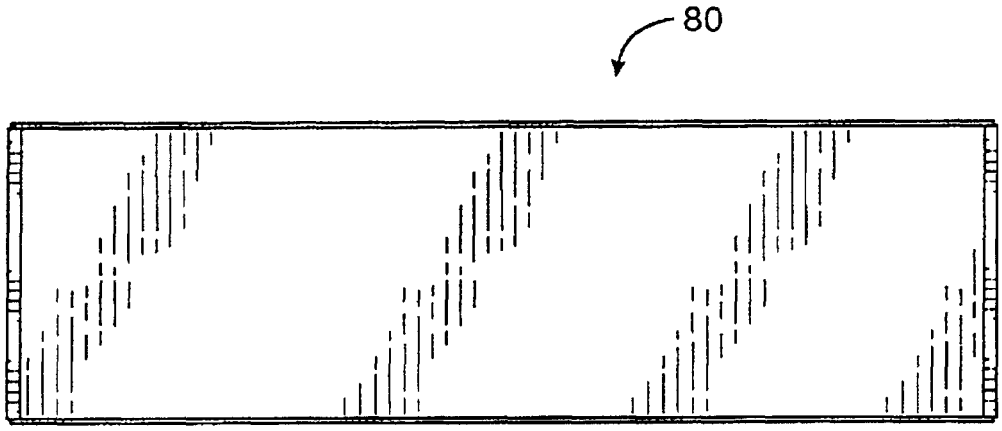
FIG. 22 is a bottom view of the headrest.

FIG. 16 is a perspective view of a headrest 80 for the cremation casket 20. FIGS. 17–22 are front, back, right side, left side, top and bottom views of the headrest 80. The headrest 80 is an optional piece that may be used beneath the head of the body within the casket 20 to put the head in a natural position. In order to allow the headrest 80 to adjust along the length of the casket 20, there is a cut-out section 82 in the front wall of the headrest 80. The cut-out 82 is sized and configured to fit over the stiffening panel 74 attached to the tray 60.

Figure 23:
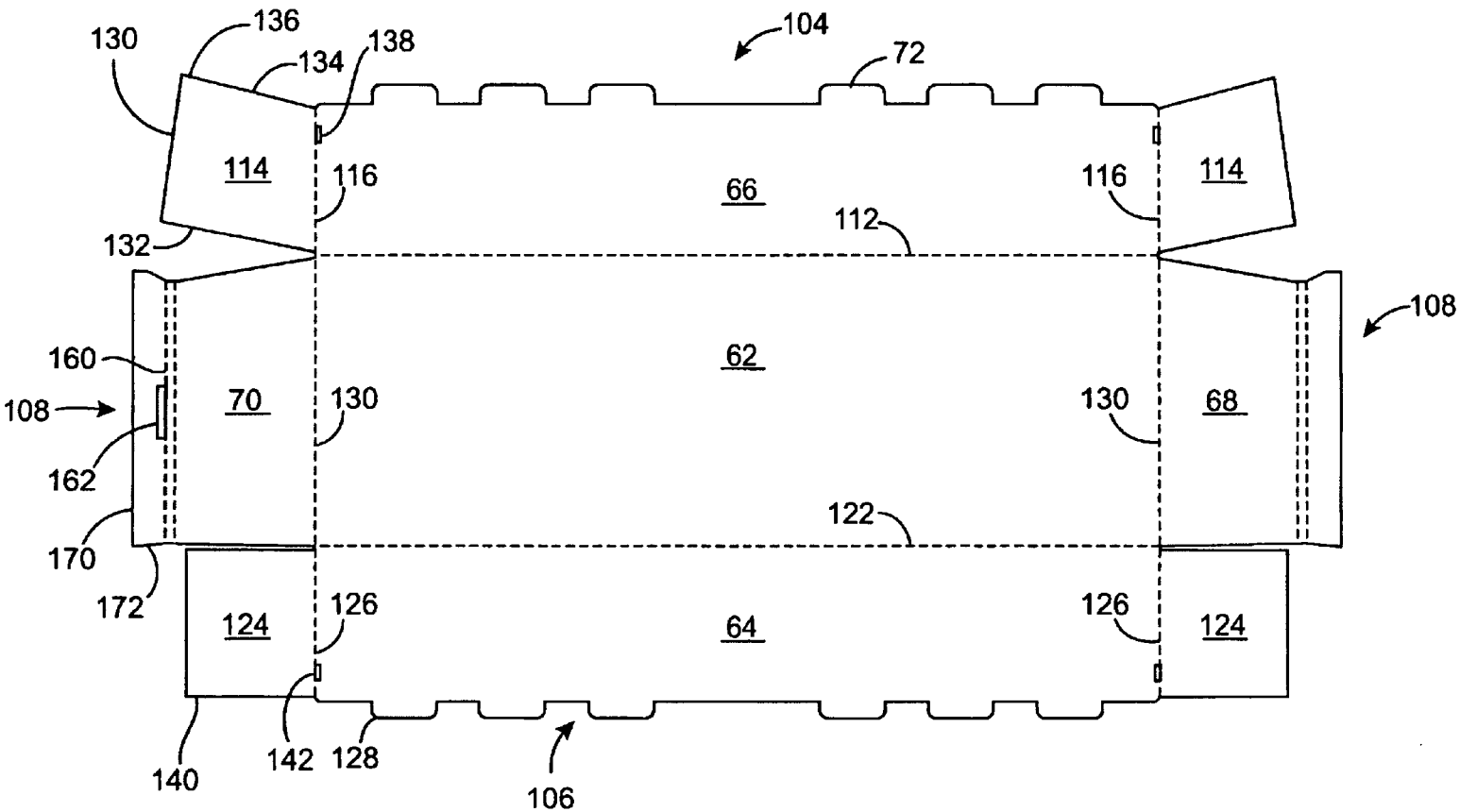
FIG. 23 is a plan view of the cut-out cardboard blank ready for folding into the tray section of the casket.

FIG. 23 is a plan view of the cut-out cardboard blank 100 ready for folding into the tray section 60 of the casket. The cut-out for the tray 60 has a central bottom section 62 that forms the rectangular bottom 62 of the tray 60, a back side section 104, a front side section 106 and a pair of end wall sections 108. The back side section 104 is connected to the bottom section 102 along a fold line 112 and is formed of three panels: a central rectangular section 66 which forms the back upstanding wall 66 of the tray 60 and two trapezoidal sections 114 extending from the ends of the central rectangular section 66. The trapezoidal sections 114 are each connected to the central rectangular section 66 at a fold line 116. The angle of the bottom edge 132 of the trapezoid section 114 to the fold line 116 is the same as the angle of the back wall 66 to the bottom 62 of the tray 60, in this case approximately 80 degrees. The outer edge 130 forms right angles to the top 134 and bottom 132 edges of the trapezoidal section 114. A small tab 136 extends out from the top edge 134 of the trapezoidal section 114. The front section 106 extends from the opposite side of the bottom section 62 from the back section 104. The front section 106 is also formed of three panels: a central rectangular section 64 forming the front upstanding wall 64 of the tray 60 and two generally square sections 124. The rectangular section 64 is connected to the bottom panel 62 at fold line 122. The square sections 124 are connected to the rectangular section 64 at fold lines 126 located at each end of the rectangular section 64. A tab 140 extends from the top edge of the square section 124. If a wider or narrower casket were formed, the square sections 124 could be narrower or wider and would then be rectangular.

At each end of the bottom section 62 are endwall sections 108. Closest to the bottom section 62 are trapezoidal sections 68, 70 that form the endwalls 68, 70 of the tray 60. The trapezoidal sections 68, 70 are connected to the bottom section 102 at fold lines 130. On each trapezoidal section 68, 70, the outer edge of the trapezoid is parallel to the fold line 130; the edge of the trapezoid proximate the front wall 64 is perpendicular to the fold line 130; and the edge of the endwall proximate the back wall 66 is at an angle to the fold line 130, the angle being approximately equal to the angle of the back wall 66 to the bottom panel 62, in this case approximately 80 degrees. The outer edge of the trapezoidal section 68, 70 is parallel to the fold line 130. The outer edge forms a fold line with a narrow rectangular section 160 that forms the top edge of the endwall 68, 70. A slot 162 in the top edge 160 is sized and configured to retain the tabs 136, 140 on the trapezoidal sections 114 and the square sections 124 when the tray 60 is assembled. Extending out from the top edge of the endwall is a trapezoidal flap 170, which helps interlock the sections together. Tabs 172 extend out from the edges and when the flap 170 is folded over the trapezoidal section 114 and the square section 124, the tabs 172 engage the slots 138, 142 in the front wall 64 and the back wall 66.

To assemble the tray section 60, the user places the bottom side of the tray section blank 100 face down. The user then fold up the front upstanding wall panel 106 and the back upstanding wall panel 104. The trapezoidal end pieces 114 and the square end pieces 124 are folded inward. The endwalls 108 are then folded up at fold line 130 the top edge of the endwall is folded over the top of the end pieces 114, 124, with the tabs 136, 140 extending through the slot 162. The flap 170 is then folded down and the tabs 172 on the edges of the flap 170 engage the slots 138, 142 in the front wall panel 120 and the back wall panel 110. Finally the second endwall is folded with the same procedure.

Figure 24:
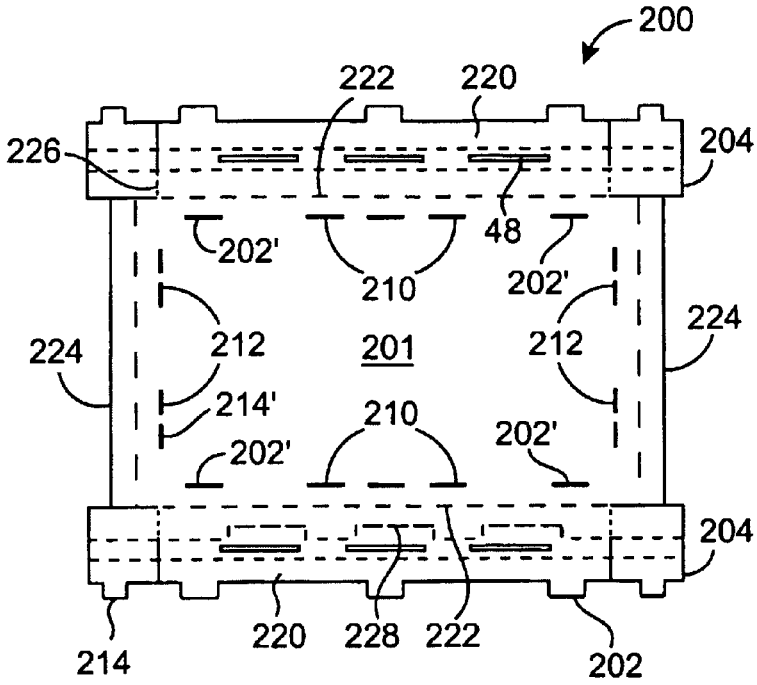
FIG. 24 is a plan view of the cut-out cardboard blank ready for folding into the lid insert piece of the casket.
Figure 25:
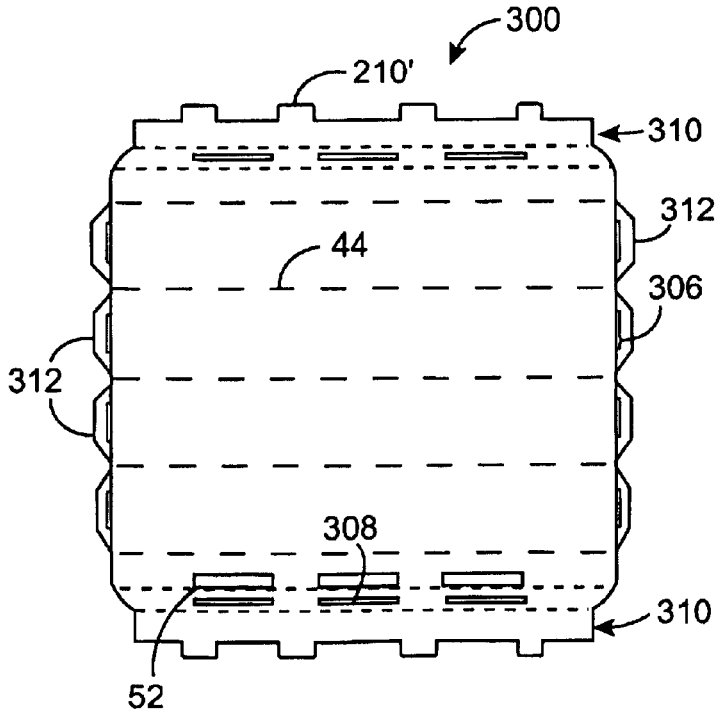
FIG. 25 is a plan view of the cut-out cardboard blank ready for folding into the outside lid piece of the casket.
Figure 26:
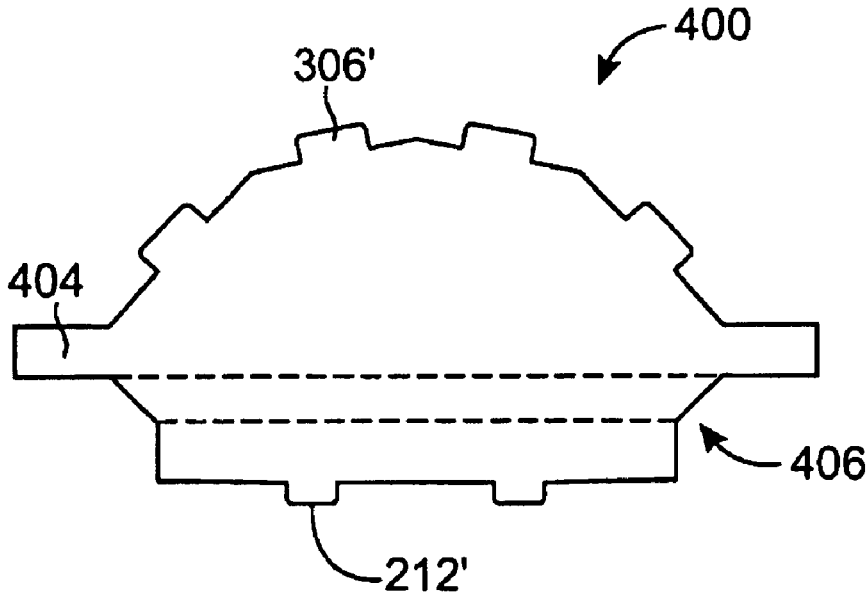
FIG. 26 is a plan view of the cut-out cardboard blank ready for folding into the end wall of the lid of the casket.

FIG. 24 is a plan view of the cut-out cardboard blank 200 ready for folding into the lid insert piece of the casket, FIG. 25 the dome section 300 and FIG. 26 the end piece 400 of the lid 40. The insert piece 200 has a rectangular central panel 201. A plurality of slots 202', 210, 212, 214' are located near the edges of the central panel 201. Rectangular stiffening panels 220 are connected at fold lines 222 to the front and back edges of the central panel 201. The stiffening panel 220 is folded along each of the fold lines to form a hollow rectangular tube along each side. The ends of the stiffening panel 220 have cuts running partially through allowing the tube to fold at line 226 such that the inner tabs 202 extend through the slots 210, 202' running parallel to the major portion of the rectangular tube, and the outmost two tabs 214 extend through the slots 214' running perpendicular to the major portion of the rectangular tube. The tabs 202 fit into the slots 202' on the central portion 201. The tabs 214 on the ends fit within the slots 214' near the sides of the insert 200. The side sections 224 are fold at a right angle to the central panel 201. When the rectangular tube is folded the cuts 228 in the insert piece 200 form small tabs which extend outward to engage the slots 52 in the dome section seen in FIG. 25 and leave the openings which align with the remaining portion of the slots 52 in the dome section.

The dome section 300 has a plurality of fold lines 44 within central portion. The dome section is creased along the fold lines 44 to create the simulation of the dome shape. The dome-shaped piece is then fitted over the insert piece 200. The front and back sections 310 of the dome section 300 fold around the hollow rectangular tube formed of the rectangular stiffening members 220. The tabs 210' are pressed into the holes 210 on the central portion of the insert piece 200. The holes 48 in the tube and the holes 48 in the dome section 300 are sized and configured to receive the tabs 72 on the tray section 100. The trapezoidal sections 312 on the side edges of the dome section 300 are folded down. Finally the end sections 400 are prepared by folding the tabs 306', 404 at a right angle to the rest of the panel 400. The dome tabs 306' are pressed into the receiving holes 306 on the dome section 300. At the same time, the side tabs 404 are pressed into openings near the based of the dome. The flap 406 at the bottom of the end piece 400 is then folded over the end sections 224 of the insert 200 and the tabs 212' are pressed into the slots 212 in the insert 200. The same procedure is used to apply a second endpiece 400 to the opposite end of the lid 40. The lid 40 is now ready to be placed on the tray 60 in either the closed or open position. When the lid 40 is placed in the closed position, the tabs 72 on the tray 60 extend through the slots 48 in the edge of the dome section 300 and the slots 48' in the insert 200. When the lid 40 is placed in the open position, the tabs 72 on the tray 60 extend through the slots 52 in the dome section and the openings formed by the cuts 228 in the insert 200. The slots 52 on one side of the dome section form the openings into which the tabs 72 from the tray 60 extend when the lid 40 is in the upright position shown in FIG. 1.

Figure 27:
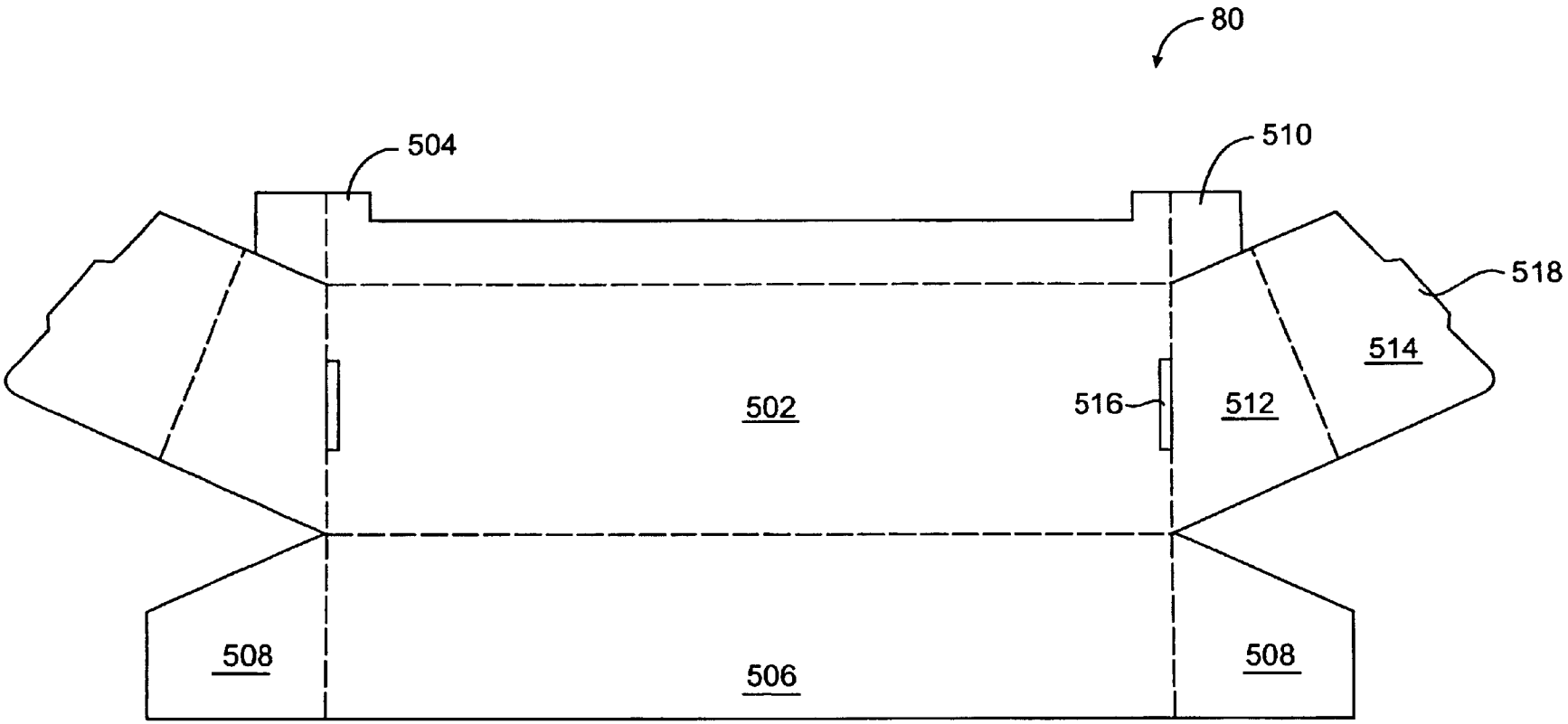
FIG. 27 is a plan view of the cut-out cardboard blank ready for folding into the headrest of the casket.

FIG. 27 is a plan view of the cut-out cardboard blank 500 ready for folding into the headrest 80 of the casket 20. The cut-out 500 for the headrest 80 has a rectangular central section 502, which forms to angled top surface of the headrest 80. A rectangular front wall section 504 is connected to the central section 502 along a fold line. At each end of the front wall section 504 are trapezoidal tabs 510 foldably connected thereto. A rectangular back wall section 506 is also connected to the central section 502 along a fold line. At each end of the back wall 506 are trapezoidal tabs 508. Two first trapezoidal sidewalls 512 are foldably connected to the central section 502, one at each end. A slot 516 is located in the central section 502 adjacent each of the fold lines. A second trapezoidal section 514 is attached to each of the first trapezoidal sections 512 along the fold lines. On the opposite end of the second trapezoidal section 514 is a tab 518 that is sized and configured to fit in the slot 516 within the central section 502.

To assemble the headrest 80, the user folds the trapezoidal tabs attached to the front wall and back walls upward, then folds the front and back walls upward. With the trapezoidal tabs located near and approximately parallel to the slot in the central section, the user folds up the side wall, then folds the section trapezoidal section over the trapezoidal tabs and down until the tab engages the slot in the central section.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A cremation casket, comprising:

a tray formed of a cardboard material, the tray having a bottom panel, a front wall, a back wall, a left wall and a right wall, the front wall, the left wall and the right wall being generally vertical and generally perpendicular to the bottom panel, the back wall being at a non-zero angle to vertical, a plurality of tabs extending upward from a top edge of the back wall, and a lid formed of the cardboard material, a top surface of the lid being rounded by a plurality of folds in the cardboard material, a bottom surface of the lid having a first plurality of slots sized and configured to engage the plurality of tabs on the tray, a back surface of the lid having a second plurality of slots also sized and configured to engage the plurality of tabs on the tray, wherein, when the tabs are located within the first plurality of slots, the lid is in a closed position covering at least approximately half of the tray, and when the tabs are located within the second plurality of slots, the lid is in an open position held upright.

2. The cremation casket of claim 1, further comprising a second lid, wherein each of the lids are sized to cover approximately half of the tray, said second lid having a bottom surface with a plurality of slots sized and configured to engage a second plurality of tabs located on the back wall of the tray.

3. The cremation casket of claim 1, further comprising a second plurality of tabs located on the front wall of the tray and a third plurality of slots located on the bottom of the lid, said third plurality of slots sized and configured to engage the second plurality of tabs when the lid is in the closed position.

4. The cremation casket of claim 1, wherein the angle is between 1 and 30 degrees.

5. The cremation casket of claim 1, wherein the angle is between 5 and 20 degrees.

6. The cremation casket of claim 1, wherein the angle is between 5 and 15 degrees.

7. The cremation casket of claim 1, wherein the angle is approximately 10 degrees and slopes toward the front wall.

8. The cremation casket of claim 1, wherein the lid is formed of four pieces: two end pieces forming end walls of the lid, an insert piece, and a dome piece, said dome piece arched over the insert and the two end pieces.

9. The cremation casket of claim 1, further comprising a least one stiffening panel attached to said bottom panel of said tray.

10. The cremation casket of claim 9, wherein said stiffening panel is formed of a honeycomb material.

11. The cremation casket of claim 1, wherein said tray section is folded from a cardboard cut-out having at least one fold line configured to allow the cardboard cut-out to be folded flat for shipping purposes.

12. The cremation casket of claim 1, wherein one surface of the cardboard material is printed with a pattern to simulate wood.

13. A cremation casket formed of a plurality of foldable cardboard cut-outs, comprising:

a tray cut-out having:

a rectangular bottom panel having a front edge, a back edge, a left edge and a right edge, a back wall section foldably connected to and extending from the back edge of the rectangular bottom panel, the back wall section having a rectangular back wall panel and first and second trapezoidal side sections extending from two opposite edges of the back wall panel, a plurality of tabs extending outward from the back wall panel, a front wall section foldably connected to and extending from the front edge of the rectangular bottom panel, the front wall section having a central rectangular front wall panel and first and second generally square side sections extending from two opposite edges of the front wall panel, first and second endwall sections foldably connected to and extending from the left and right edges of the rectangular bottom panel, each endwall section having a trapezoidal side panel adjacent the bottom panel, opposite the bottom panel and foldably connected to the trapezoidal side panel is a top edge panel connected thereto, a flap is foldably connected to the top edge panel, a lid having:

an insert panel having a generally rectangular central section having a plurality of slots located near the edges thereof, two stiffening panels located on opposite sides of the central section and being configured to fold into a hollow tube and two side sections located on opposite sides of the central section, a plurality of tabs extending from each of the stiffening panels, the tabs sized and configured to engage at least one of the plurality of slots, a dome panel having a plurality of generally rectangular central sections separated by fold lines, wherein, when the fold lines are folded at oblique angles, the dome panel is formed into a generally dome shape, the dome panel having a plurality of tabs foldably connected to and extending from ends of the rectangular central sections and a plurality of slots located along the fold lines connecting the tabs to the rectangular central sections, two end wall panels having a plurality of tabs foldably connected to and extending from the perimeter thereof, the plurality of tabs sized and configured to engage the slots in the dome section and in the insert panel.

14. The cremation casket of claim 13, further comprising a plurality of tabs extending outward from the front wall panel of said tray cut-out.

15. The cremation casket of claim 13, further comprising first tabs on the first and second trapezoidal side sections of the back wall section, second tabs on the first and second square side sections of the front wall section and a slot extending through the top edge panel of each endwall section.

16. The cremation casket of claim 13, further comprising a second lid.

17. The cremation casket of claim 13, further comprising printing to simulate wood on at least one side of the tray and the lid.

18. The cremation casket of claim 13, wherein the trapezoidal sections of the tray cut-out cause the tray to have an angled back wall.

19. The cremation casket of claim 18, wherein the angle of the back wall is between 5 and 15 degrees.

20. The cremation casket of claim 13, further comprising a headrest having:

a generally rectangular central -section having a front edge, a back edge, a left edge and a right edge, a front wall foldably connected to and extending from the front edge of the central section, a back wall foldably connected to and extending from the back edge of the central section, and first and second side wall sections foldably connected to and extending from the left and right edges of the central section.

* * * * *

UNITED STATES PATENT AND TRADEMARK OFFICE

CERTIFICATE OF CORRECTION

PATENT NO. : 7,003,855 B2 
APPLICATION NO. : 09/855814
DATED : February 28, 2006
INVENTOR(S) : Chen Lew It is certified that error appears in the above-identified patent and that said Letters Patent is hereby corrected as shown below:

Title Page

Item (54), Title, and Column 1, lines 1 and 2, should read: EARTH -FRIENDLY CARDBOARD CASKETS FOR CREMATION AND BURIAL Item (76), Inventor, should read: Chen Lew, 19140 Stevens Creek Blvd, Suite C-102, Cupertino, CA (US) 95014

Item (57) Abstract, delete lines 1-14 and substitute Abstract

— A collapsible casket for cremation and burial is formed of cardboard and has the appearance of a typical wood or metal casket. The casket is assembled by folding along pre-scored lines to form a two-piece raised lid, those having a plurality of slots on the bottom and a set of slots in the back edge. The slots engage a plurality of tabs extending upward from the top of the back wall of the tray. Tabs within the slots on the back of the lid and the slope of the back wall of the tray provide support for the lid to stand in an upright position. When the tray is covered with the lid, the tabs engage the slots in the bottom wall of the lid, thereby securely holding the lid in place. During a ceremony, one lid section may be closed position and the second lid is upright, thereby giving the appearance of a standard two-part casket lid. --

Signed and Sealed this

Eighth Day of August, 2006

JON W. DUDAS
*Director of the United States Patent and Trademark Office*